US010480903B2

(12) United States Patent
Lupher et al.

(10) Patent No.: US 10,480,903 B2
(45) Date of Patent: Nov. 19, 2019

(54) RIFLE SCOPE AND METHOD OF PROVIDING EMBEDDED TRAINING

(75) Inventors: John Hancock Lupher, Austin, TX (US); John Francis McHale, Austin, TX (US)

(73) Assignee: TrackingPoint, Inc., Austin, TX (US)

( * ) Notice: Subject to any disclaimer, the term of this patent is extended or adjusted under 35 U.S.C. 154(b) by 0 days.

(21) Appl. No.: 13/460,829

(22) Filed: Apr. 30, 2012

(65) Prior Publication Data

US 2013/0288205 A1 Oct. 31, 2013

(51) Int. Cl.
*F41G 3/26* (2006.01)

(52) U.S. Cl.
CPC ..... *F41G 3/2627* (2013.01); *F41G 3/2644* (2013.01)

(58) Field of Classification Search
CPC .... F41G 3/2655; F41G 3/2644; F41G 3/2627; F41G 3/26; F41G 3/2605; F41G 3/2611; F41G 3/2622; F41G 3/265; F41A 33/00; F41A 33/02; F41A 33/04; F41A 33/06
USPC ..... 434/19, 22
See application file for complete search history.

(56) References Cited

U.S. PATENT DOCUMENTS 3,964,178 A 6/1976 Marshall et al.
5,216,612 A * 6/1993 Cornett et al. ..... 700/96
5,991,043 A 11/1999 Andersson et al.
7,291,014 B2 * 11/2007 Chung et al. ..... 434/11
8,230,635 B2 * 7/2012 Sammut et al. ..... 42/122
8,360,776 B2 * 1/2013 Manard et al. ..... 434/23
2005/0017456 A1 * 1/2005 Shechter ..... 273/371
2006/0150468 A1 7/2006 Zhao
2006/0204935 A1 * 9/2006 McAfee ..... F41A 33/00 434/22
2007/0077539 A1 * 4/2007 Tzidon ..... F41G 3/2661 434/21
2007/0287132 A1 * 12/2007 LaMons ..... F41A 33/00 434/11
2008/0309916 A1 * 12/2008 Mok ..... 356/5.01
2009/0155747 A1 * 6/2009 Cornett ..... F41G 3/2633 434/22
2010/0273130 A1 10/2010 Chai et al.
2011/0167708 A1 * 7/2011 Cheng ..... F41G 1/345 42/114
2011/0207089 A1 * 8/2011 Lagettie ..... F41G 3/2627 434/22

(Continued)

FOREIGN PATENT DOCUMENTS

CN 1702423 11/2005
JP 11006700 1/1999

(Continued)

OTHER PUBLICATIONS

The Inertial Reticle Technology (IRT) Applied to an M16A2 Rifle Firing From a Fast Attack Vehicle (Brosseau, T. L.).*

*Primary Examiner* — Timothy A Musselman
(74) *Attorney, Agent, or Firm* — RM Reed Law PLLC

(57) ABSTRACT

A method includes providing a visual representation of a targeting environment to a display of a rifle scope, where the visual representation includes a target and a reticle. The method further includes receiving a trigger pull signal at a processor coupled to the display, determining an impact location of a virtual shot in response to receiving the trigger pull signal, and dynamically adjusting the target within the visual representation in response to determining the impact location.

21 Claims, 4 Drawing Sheets

(56) References Cited

U.S. PATENT DOCUMENTS

| | | | | |
|---|---|---|---|---|
| 2011/0315767 | A1* | 12/2011 | Lowrance | F41G 3/02<br>235/404 |
| 2015/0101229 | A1* | 4/2015 | Hall | F41A 19/64<br>42/69.01 |

FOREIGN PATENT DOCUMENTS

| | | |
|---|---|---|
| JP | 2006207977 | 8/2006 |
| JP | 2006250405 | 9/2006 |
| TW | 1286202 | 1/2006 |
| WO | 9415165 | 7/1994 |

* cited by examiner

RIFLE SCOPE AND METHOD OF PROVIDING EMBEDDED TRAINING

FIELD

The present disclosure is generally related to telescopic devices, and more particularly, to rifle scopes and methods of providing embedded training.

BACKGROUND

Conventionally, training with gun scopes requires the firearm owner to take the firearm with the gun scope to a firing range or a field to shoot at targets and to make adjustments to the gun scope setting. Training with other firearm users, including military or police personnel, may include simulated firing and/or paint ball training exercises.

In some instances, military and police personnel may use situational training systems involving actuated targets and/or simulated targets to train to improve aim and shooting skills for firing rifles, shotguns, handguns, air guns, and other weapons. Such systems may display targeting environments on a screen and may include sensors configured to detect signals corresponding to the discharge of the training device and to determine the aim point of the training device. The determination of the aim point allows the system to determine whether a target was hit and to adapt the targeting environment to reflect the result of the shot.

However, such training systems utilize specialized equipment, allowing the user to train with the specialized equipment. Unfortunately, such specialized equipment can differ from the user's actual weapon in significant ways and may have different aim point characteristics as compared to the user's weapon. Further, such training systems can be expensive and require facilities designed to house such systems.

SUMMARY

In an embodiment, a method includes providing a visual representation of a targeting environment to a display of a rifle scope, where the visual representation includes a target and a reticle. The method further includes receiving a trigger pull signal at a processor coupled to the display, determining an impact location of a virtual shot in response to receiving the trigger pull signal, and dynamically adjusting the target within the visual representation in response to determining the impact location.

In another embodiment, a rifle scope includes a display, an input interface configured to receive a user input, a processor coupled to the display and the input interface, and a memory coupled to the processor. The memory is configured to store instructions that, when executed by the processor, cause the processor to provide a visual representation of a targeting environment to the display, where the visual representation includes a target. The memory further includes instructions that, when executed, cause the processor to receive a trigger pull signal from the input interface, determine an impact location of a virtual shot in response to receiving the trigger pull signal, and dynamically adjust the target within the visual representation based on determining the impact location.

In still another embodiment, a rifle scope having embedded training includes a display, a processor coupled to the display, and a memory accessible to the processor. The memory is configured to store instructions that, when executed, cause the processor to provide a visual representation of a targeting environment to the display, determine a trigger pull, and provide training results to the display by selectively adjusting at least one target within the visual representation in response to the trigger pull.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Embodiments of systems and methods are described below that provide embedded training. In an example, a rifle scope includes a display and a controller coupled to the display and configured to provide a visual representation of a targeting environment to the display. The controller is configured to detect a trigger pull and to determine an impact location of a virtual shot relative to a target based on the movement and angle of a firearm attached to the telescopic device when the trigger is pulled. The controller is further configured to adjust the position of the target and/or to cause the target to move or respond to the virtual shot based on the impact location. An example of a telescopic device that can be implemented as a rifle scope and that is configured to provide embedded training is described below with respect to FIG. 1.

Figure 1:
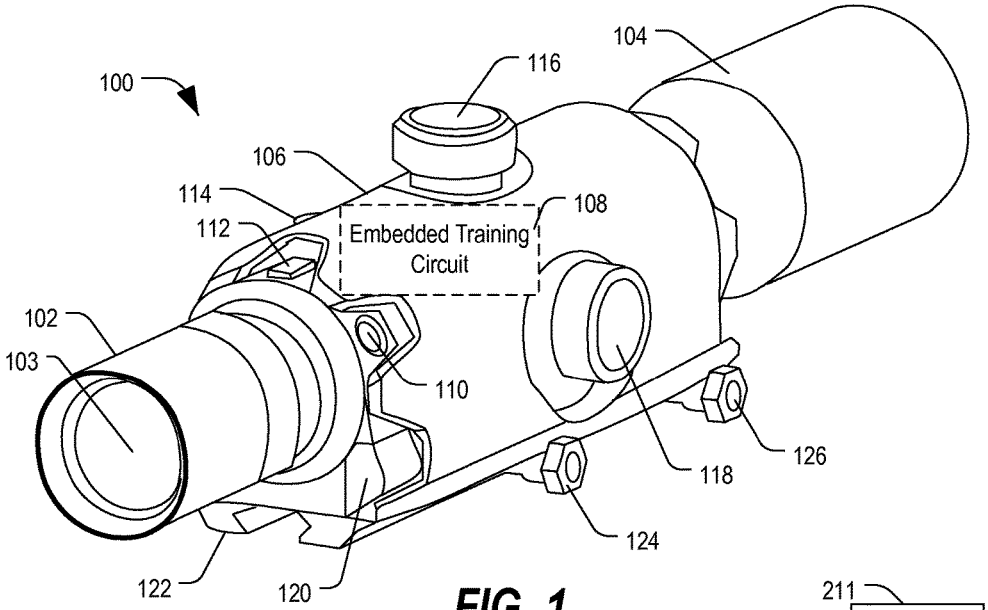
FIG. 1 is a perspective view of an embodiment of a telescopic device including an embedded training circuit.

FIG. 1 is a perspective view of an embodiment of a telescopic device 100 including an embedded training circuit 108. Telescopic device 100 is one possible example of a gun scope that could be configured to provide embedded training. Telescopic device 100 can be mounted to a rifle, a pistol, an air gun, and other small arm firearms. However, telescopic devices may also include spotting scopes, binoculars, and other optical devices that provide optical magnification, which can be configured to communicate with telescopic device 100 or that can otherwise receive virtual shot information to provide embedded training.

Telescopic device 100 includes an eyepiece 102 and an optical element 104 coupled to a housing 106. Housing 106 defines an enclosure sized to receive embedded training circuit 108. Optical element 104 includes an objective lens and other components configured to receive light and to direct and focus the light toward optical sensors associated with embedded training circuit 108.

Telescopic device 100 further includes user-selectable buttons 110 and 112 on the outside of housing 106 that allow the user to interact with embedded training circuit 108 to select between operating modes, to adjust settings, and so on. In some instances, the user may interact with at least one of the user-selectable buttons 110 and 112 to select a target within the view area, to initiate laser range finder operations, and so on. In another instance, target selection may be performed by selecting a button on a grip of the firearm, which may be coupled to embedded training circuit 108 through a wired or wireless connection. Further, telescopic device 100 includes thumbscrews 114, 116, and 118, which allow for manual adjustments.

Housing 106 includes a removable battery cover 120, which secures a battery within housing 106 for supplying power to embedded training circuit 108. Housing 106 is coupled to a mounting structure 122, which is configured to mount to a surface of a portable structure (such as a rifle or other firearm) and which includes fasteners 124 and 126 that can be tightened to secure the housing to the portable structure.

In an example, telescopic device 100 is mounted to a firearm as a rifle scope and configured to detect a trigger pull and/or to receive user inputs. A user may view a visual representation of a view area of telescopic device 100. In a first mode, the visual representation may correspond to optical data captured by optical element 104 and provided to optical sensors. In a second mode, the visual representation may correspond to a training environment including one or more targets, which can be presented on a display that is coupled to or part of embedded training circuit 108. Embedded training circuit 108 detects user interactions, such as button presses and trigger pulls, and makes adjustments to the visual representation according to the context.

In one example, the user may interact with a button (such as buttons 110 and 112 or a button on a grip or trigger assembly of an associated firearm) to cause a processor of telescopic device 100 to provide a visual representation of a targeting environment to a display within telescopic device 100. The user may then aim and fire at selected targets within the targeting environment, and embedded training circuit 108 is configured to determine the impact location of the virtual shot based on the visual representation and to selectively alter the target position or its response (in the event of a virtual animal target) to the impact location. For example, in the event that the impact location is determined to have missed the target, embedded training circuit 108 may determine that the target would flee from the impact location and may show the target fleeing the view area. In another example, if the impact location is determined to have hit the target, embedded training circuit 108 may alter a position of the target within the view area, for example, by displaying an exploding bottle (if the target is a bottle) or by showing the animal target fall to the ground. In general, embedded training circuit 108 determines an appropriate response for the target based on the determined impact location and adjusts the visual representation accordingly.

The above-example is a telescopic device 100 that could be implemented as a rifle scope or as some other optical device that provides magnification of a view area. Telescopic device 100 can be implemented as a digital device that can communicate with smart phones, other telescopic devices, and other circuitry. One possible example of a system including embedded training circuit 108 is described below with respect to FIG. 2.

Figure 2:
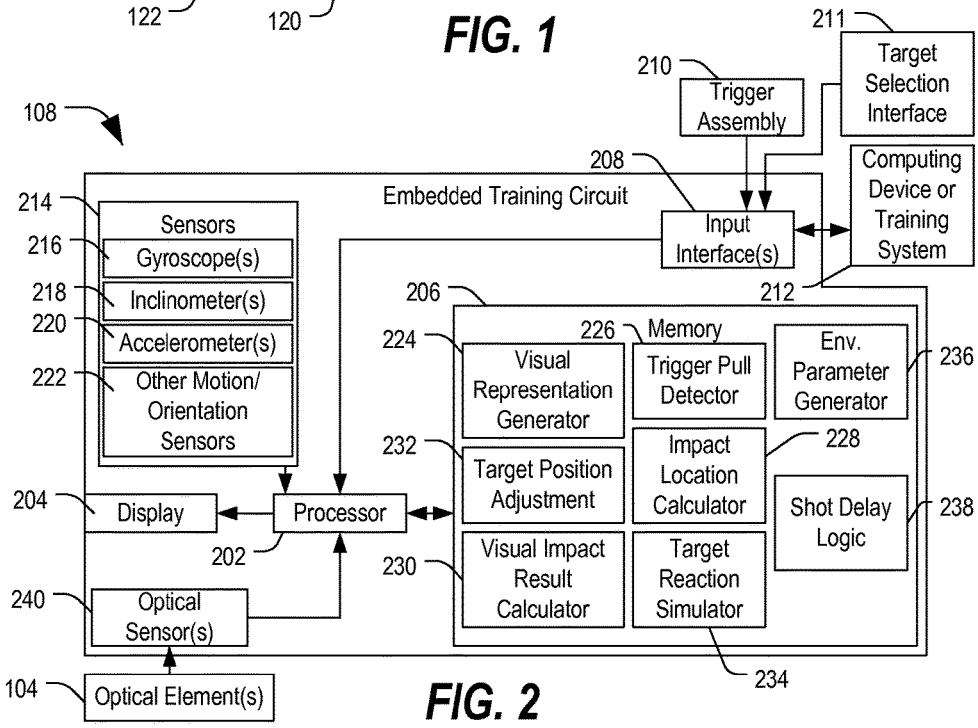
FIG. 2 is a block diagram of an embodiment of a system including the embedded training circuit of FIG. 1.

FIG. 2 is a block diagram of an embodiment of a system 200 including the embedded training circuit 108 of FIG. 1. System 200 includes a trigger assembly 210 (of a firearm) and a target selection interface 211 (such as buttons, a touch screen, etc.) coupled to embedded training circuit 108. Additionally, embedded training circuit 108 is configured to receive optical signals from one or more optical elements 104 and to selectively communicate with a computing device or other training system 212.

Embedded training circuit 108 includes a processor 202 coupled to a display 204 and to a memory 206. Processor 202 is also coupled to one or more input interfaces 208, to sensors 214, and to optical sensors 240. Optical sensors 240 receive directed light from optical elements 104 to sense visual elements, for example, when telescopic device 100 is in a telescope mode as opposed to a training mode. Optical sensors 240 provide optical data corresponding to a view area of telescopic device 100 to processor 202.

Sensors 214 include one or more gyroscopes 216, one or more inclinometers 218, one or more accelerometers 220, other motion/orientation sensors 222, or any combination thereof. Sensors 214 communicate motion, incline, and orientation data associated with an orientation of the telescopic device 100 (assuming telescopic device 100 is aligned to the longitudinal axis of the corresponding firearm) to processor 202.

Input interfaces 208 include a first interface coupled to a trigger assembly 210 of the firearm for receiving a signal corresponding to movement of the trigger shoe. Input interfaces 208 further include a second interface configured to receive one or more signals from a target selection interface 211, such as buttons (on telescopic device 100, on a grip of the firearm, or in another location), a touch screen, or another user interface. Input interfaces 208 also include a third interface configured to communicate with a computing device or another training system 212 through a wired or wireless interface. In an example, input interfaces 208 include one or more transceivers configurable to communicate bi-directionally with the computing device or training system 212.

Processor 202 executing instructions stored in memory 206 operates as a controller configured to provide a visual representation of a targeting environment to a display. Memory 206 is a computer or processor-readable storage medium configured to store data and processor-executable instructions. Memory 206 stores a visual representation generator 224 that, when executed, causes processor to provide a visual representation and a reticle to display 204. The visual representation includes one or more targets. In one instance, the visual representation can be a combination of captured optical information from optical elements 104 and optical sensors 240 and overlay information, such as laser range finding data, a reticle, a visual marker or tag visibly attached to a selected target, and the like. In another instance, the visual representation provided to display can include a generated visual representation of a target environment plus the reticle and other information. Using movement and orientation data from sensors 214, processor 202 can adjust the visual representation to reflect the orientation information.

Memory 206 further includes trigger pull detection instructions 226 that, when executed, cause processor 202 to detect a trigger pull based on a signal received from trigger assembly 210. Memory 206 also includes impact location calculator instructions 228 that, when executed, cause processor 202 to calculate an impact location of a virtual shot within the visual representation based on orientation and movement information from sensors 214. Memory 206 also includes visual impact result calculator instructions 230 that, when executed, cause processor 202 to calculate a change in the visual representation based on the impact location. When a shot hits a target or misses, the impact of the shot should leave a hole or kick up a cloud of dust or something to reflect the impact location in the visual representation. Additionally, memory 206 includes target position adjustment instructions 232 that, when executed, causes processor 202 to adjust the visual representation to reflect a change in the position of the target based on the impact location. For example, if the selected target is can or bottle and the impact location indicates that the shot was successful, the can or bottle should move based on the impact location, and target position adjustment instructions 232 are executed by processor 202 to determine a location where the target comes to rest after impact.

Memory 206 further includes target reaction simulator instructions 234 that, when executed, cause processor 202 to determine a reaction by the target (in the event that the target is a live target) to the impact location. In particular, if the shot misses, an animal may be startled by the sound of the impact and may flee the view area. Similarly, if an animal is hit, but the shot is not a "kill shot", the animal may react to the impact and flee or take evasive action, such as ducking into a nearby hole or hiding in tall grass. Target reaction simulator instructions 234 are used by processor 202 to generate a likely reaction by the target, and the resulting information can be used to update the target position within the visual representation.

Memory 206 also includes environmental parameter generator instructions 236 that, when executed, cause processor 202 to calculate environmental parameters, such as wind speed and direction, rain, humidity, barometric pressure, or other environmental conditions. In some instances, such information can be used to adjust the visual representation such as by causing visual elements within the visual representation to bend or move, for example, to make the visual representation more realistic for the user. Further, environmental parameter generator instructions 236 may include randomness functions to simulate variability of environmental parameters, which information can be included within the impact location calculations to predict an impact location, which may be a hit or a miss, depending on the particular shot. Memory 206 may further include shot delay logic 238 that, when executed, causes processor 202 to delay discharge of the associated firearm (after detecting a trigger pull from trigger assembly 210) until a selected target is aligned to the center of the reticle within the visual representation. In an example, a user may interact with target selection interface 211 to select a target and to visually mark the target. In one example, the user selects the target by pressing a target selection button when the target is at a center of the reticle. In another example, the user selects the target by pressing the target selection button, aligning the center of the reticle to the desired target in the visual representation, and releasing the target selection button when the center of the reticle is aligned to the target. In one instance, shot delay logic 238 causes processor 202 to delay the virtual shot until the center of the reticle is aligned to the target; however, user jitter, random environmental parameters, and other variables may cause impact location calculator 228 to determine that the target is missed, in which case target reaction simulator instructions 234 and visual representation generator instructions 224 cooperate to provide a relatively realistic visual representation including a likely reaction by the target to the impact location of the missed shot.

As discussed above, processor 202 executes visual representation generator instructions 224 that can produce a visual representation of a targeting environment and a reticle configured to overlay the visual representation. The visual representation of the targeting environment is adjusted automatically by processor 202 executing visual representation generator instructions 224 such that, as the user changes the orientation of telescopic device 100, the visual representation is adjusted to reflect the changing orientation. An example of a visual representation of a view area that may be generated by embedded training circuit 108 for presentation to display 204 of telescopic device 100 is described below with respect to FIG. 3.

Figure 3:
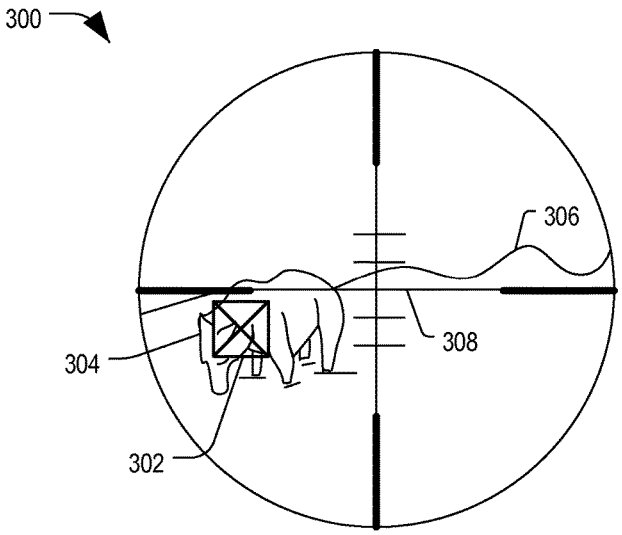
FIG. 3 is a diagram of an embodiment of a view area of the telescopic device of FIG. 1 including a target being tracked by a processor of the telescopic device using a visual tag.

FIG. 3 is a diagram of an embodiment of a view area 300 of the telescopic device 100 of FIG. 1 including a target 304 being tracked by processor 202 of the telescopic device 100 using a visual tag 302. View area 300 includes a reticle 308 and a processor-generated landscape 306 (targeting environment). View area 300 depicts the visual representation with target 304 already selected and visually marked using visual tag (visible marker) 302. If the user were to change the orientation of telescopic device 100 to the left, target 304 would shift toward the center of reticle 308 and background 308 would be adjusted as well. Once target 304 is aligned to the center of reticle 308, shot delay logic 238 allows the virtual shot to proceed, and processor 202 calculates the impact location of the virtual shot using impact location calculator 228 to determine whether the virtual shot hit or missed target 304.

It should be appreciated that visual representation generator instructions 224 may be configured to cause processor 202 to provide a variety of different visual representations and corresponding targets, including a savannah environment with corresponding animal targets, a jungle environment with corresponding animal targets, a woodland environment with corresponding animal targets, a field with various targets, a target range, a mountainous environment, and the like. In police and military contexts, visual representation generator instructions 224 may be configured to cause processor 202 to provide cityscape environments, jungle environments, mountainous or cavernous environments, and other training environments, including residential scenarios, hostage situation scenarios, and various other training environments, including human or animal targets.

While the above-examples have depicted and described a telescopic device that can be used as a gun scope and that includes embedded training, it should be appreciated that the functionality described above can be extended to other telescopic environments that require user training, including microscope environments that could present a visual scenario to a user and then adjust the visual representation based on the user's interactions with the microscope controls to train the user. Further, gaming-type scenarios may also be presented to allow the user to receive firearm training against surreal or imaginary foes. Additionally, though the above-described device and circuitry includes a display, in some instances, the training environment may be presented to a display of a smart phone or tablet computer, to an attached display, or to another telescopic device through a wireless communication channel. Alternatively, telescopic device 100 may communicate with a helmet, glasses, or goggles configured to receive data corresponding to the embedded training environment and that displays the data on a display.

In an example, telescopic device 100 is configured to calculate or estimate an impact location corresponding to a ballistics reticle when the user selects a target and to estimate an impact location of a shot relative to the ballistics reticle in response to a trigger pull. The user may interact with the training environment presented on a display of the scope. One possible example of a method of providing embedded training using a telescopic device is described below with respect to FIG. 4.

Figure 4:
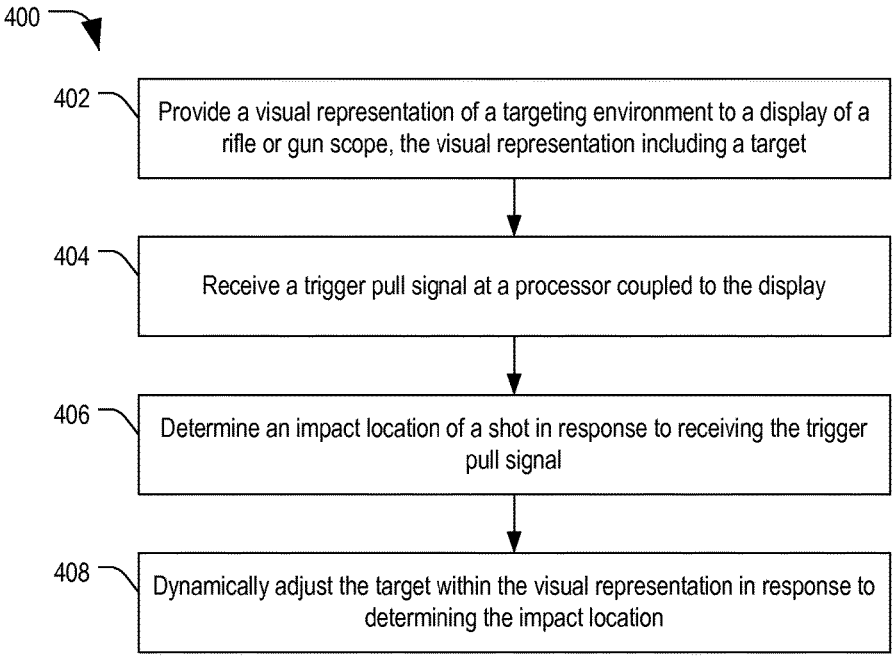
FIG. 4 is a flow diagram of an embodiment of a method of dynamically adjusting a target within the visual representation in response to an impact location to provide embedded training.

FIG. 4 is a flow diagram of an embodiment of a method 400 of dynamically adjusting a target within the visual representation in response to an impact location to provide embedded training. At 402, a visual representation of a targeting environment is provided to a display of a rifle or gun scope, where the visual representation includes a target. In an example, a controller (such as processor 202 executing instructions stored in a memory 206) provides the visual representation of the targeting environment to display 204 of telescopic device 100, implemented as a rifle or gun scope. Advancing to 404, a trigger pull signal is received at a processor coupled to the display. In an example, processor 202 receives a trigger pull signal from input interface 208, which trigger pull signal corresponds to movement of a trigger shoe of trigger assembly 210. As previously discussed, processor 202 executes trigger pull detector 226 to detect the signal.

Continuing to 406, an impact location of a shot is determined in response to receiving the trigger pull signal. As mentioned above, processor 202 executes impact location calculator instructions 228 to determine the impact location as a function of the orientation and movement of the gun scope at the time the shot was taken as well as environmental parameters calculated by environmental parameter generator 236 at the time the shot was taken.

Continuing to 408, the target is dynamically adjusted within the visual representation in response to determining the impact location. In an example, processor 202 executes visual representation generator instructions 224, target position adjustment instructions 232, and target reaction simulator instructions 234 to determine the result of the shot with respect to the visual representation of the target. If the shot is missed, the target may flee or an object hit by the shot may reflect the impact (such as with the display of a gash or hole). The target reaction and/or the effect of the shot may be calculated and used to adjust the visual representation.

Method 400 represents one possible flow diagram of a method of providing feedback to the user (as part of the embedded training) to reflect the user's shot. Another example of a method is described below with respect to FIG. 5.

Figure 5:
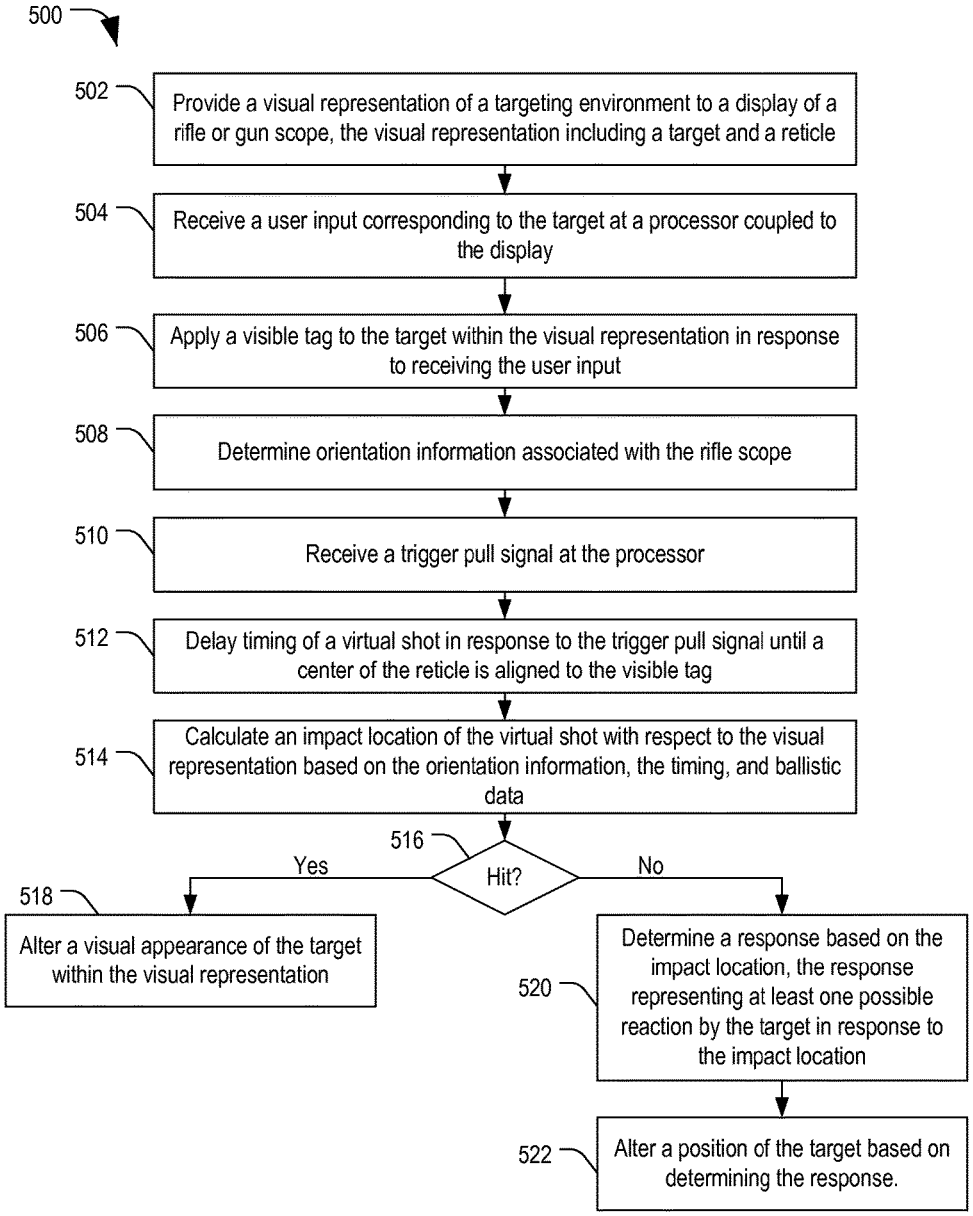
FIG. 5 is a flow diagram of a second embodiment of a method of providing embedded training.

FIG. 5 is a flow diagram of a second embodiment of a method 500 of providing embedded training. At 502, a visual representation of a targeting environment is provided to a display of a rifle or gun scope, where the visual representation includes a target and a reticle. Advancing to 504, a user input corresponding to the target is received at a processor coupled to the display. Continuing to 506, a visible tag (such as visual tag or marker 302 in FIG. 3) is applied to the target within the visual representation in response to receiving the user input.

Moving to 508, orientation information associated with the rifle scope is determined. It should be appreciated that movement and changes in orientation of the rifle scope impact the visual representation, and that processor 202 continuously adjusts the visual representation to reflect movement and orientation of the rifle scope.

Proceeding to 510, processor 202 receives a trigger pull signal. Advancing to 512, timing of a virtual shot is delayed in response to the trigger pull signal until a center of the reticle is aligned to the visible tag (which was applied to the target in 506). In an example, processor 202 tracks movement of the target and adjusts the position of the visible tag within the visual representation to remain attached to the target independent of the position of the reticle. Continuing to 514, an impact location of the virtual shot is calculated with respect to the visual representation based on the orientation information, the timing, and ballistic data. Further, as mentioned above, the impact location may be influenced by movement of the user or the target, by generated environmental parameters, and the like.

Moving to 516, if the target is hit, method 500 advances to 518 and a visual appearance of the target is altered within the visual representation. For example, if the target is a static target, such as a bull's eye or a tree, the visual representation may be updated to depict a hole in the bull's eye or the tree representing the impact of the shot. If the target is an animal, the target may be updated to depict a wound or to reflect the animal falling to the ground.

At 516, if the target is not hit, method 500 advances to 520 and a response is determined based on the impact location, where the response represents at least one possible reaction by the target in response to the impact location of the virtual shot. For example, if the shot hits a nearby tree, the target may be startled and may flee. Alternatively, the target may look around without moving. The target reaction may be variable and may include at least some randomness to allow for variability of the target reaction. Continuing to 522, a position of the target is altered based on determining the response. In other words, the calculated reaction of the target may be used to estimate the target's reaction to the miss and the visual representation generator instructions 224 to cause processor 202 to represent the target within the visual representation to reflect the calculated reaction. In some instances, the target may flee the view area and/or hide.

While the above-discussion of FIGS. 1-5 describes embedded training provided to a single user through his or her telescopic device, embedded training circuit 108 may include one or more transceivers to allow communication between devices, such as through a network or through a wireless connection. In an example, multiple users may share a group training exercise, which can be presented through the respective gun scopes. An example of a system of providing group or shared training is described below with respect to FIG. 6.

Figure 6:
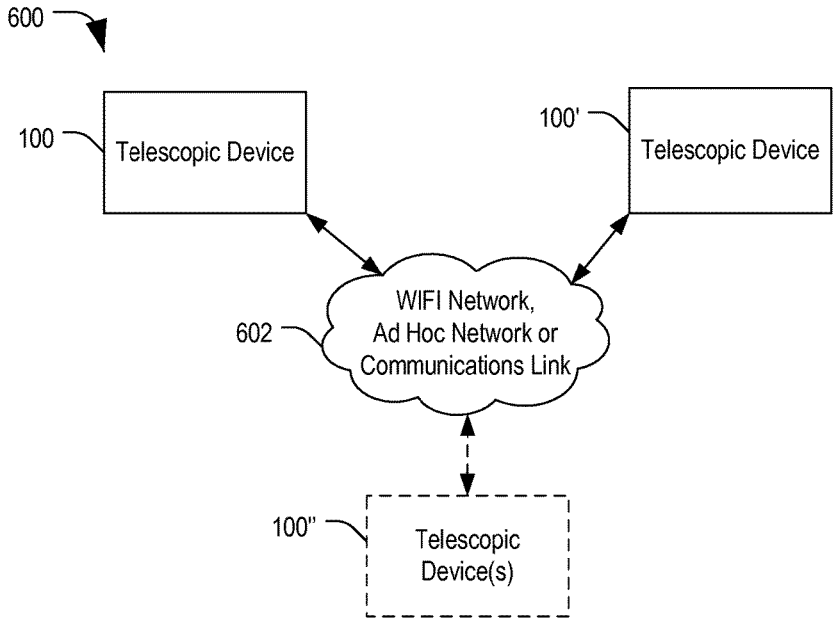
FIG. 6 is a block diagram of an embodiment of a system including multiple embedded training systems configured to communicate to provide a shared embedded training environment.

FIG. 6 is a block diagram of an embodiment of a system 600 including multiple embedded training systems configured to communicate to provide shared embedded training environment. System 600 includes a first telescopic device 100 including embedded training circuit 108, which is configured to communicate wirelessly with one or more other telescopic devices 100' and 100" through a wireless network 602, such as a local area network, a digital or cellular communications network, a Bluetooth® communications channel, or some other short-range wireless communication protocol. The one or more other telescopic devices 100' and 100" also include instances of embedded training circuit 108.

In an example, each telescopic device 100, 100', and 100" includes visual representation generator instructions 224 within an embedded training circuit 108 that is configured to provide a visual representation. The visual representation may represent a pre-defined training scenario, and telescopic devices 100, 100' and 100" may be configured to share timing information and virtual shot trajectory (impact location data) to synchronize the display of the visual representations, though each telescopic device 100, 100', and 100" displays a portion of the visual representation that corresponds to the orientation and movement of the particular telescopic device 100, 100', and 100" independent of the others. To the extent that two telescopic devices, such as telescopic devices 100 and 100' are oriented toward the same view area, the resulting visual representations on the displays of those devices should be synchronized as well, such that they see the same visual representation. In other instances, telescopic device 100 may transmit the visual representation to the other telescopic devices 100' and 100" to allow a shared training experience. In either instance, virtual shot information may be shared between the telescopic devices 100, 100' and 100" to update the visual representations on each of their respective displays. In one example, a group of military or police personnel may train with one another on a shared training exercise through a coordinated visual representation.

In conjunction with the systems, circuits, and methods described above with respect to FIGS. 1-6, a telescopic device includes a display and a controller coupled to the display. In some instances, the controller may be a field programmable gate array circuit. In other instances, the controller may be a micro-controller unit (MCU) or processor configured to execute instructions stored in a memory. The controller is configured to provide a visual representation of a targeting environment to the display, determine a trigger pull, and provide training results to the display by selectively adjusting at least one target within the visual representation in response to the trigger pull. The controller determines an impact location of a virtual shot in response to the trigger pull as a function of the orientation and movement of the telescopic device and as a function of the ballistics, environmental parameters, and position/movement of the target at the time of the virtual shot. In some instances, telescopic device updates the visual representation to reflect the impact location and/or to reflect a response by the target to the virtual shot.

Although the present invention has been described with reference to preferred embodiments, workers skilled in the art will recognize that changes may be made in form and detail without departing from the scope of the invention.

What is claimed is:

1. A method comprising:

in a first mode:

capturing optical data using optical sensors of a rifle scope;

providing the optical data to a display within the rifle scope that is viewable through a viewing lens of the rifle scope; and in a second mode:

providing a visual representation of a targeting environment to the display of the rifle scope using a processor within the rifle scope, the visual representation including a target and including a reticle;

receiving a trigger pull signal at the processor;

determining an impact location of a virtual shot in response to receiving the trigger pull signal using the processor; and dynamically adjusting the target within the visual representation in response to determining the impact location using the processor.

2. The method of claim 1, wherein dynamically adjusting the target comprises adjusting at least one of a position and an orientation of the target based on the impact location.

3. The method of claim 1, further comprising:

receiving a user input corresponding to at least one of a button press and a button release to select the target within the visual representation;

applying visible marker to the target within the visual representation, the visible marker comprising a visual tag applied by the processor to the target within the visual representation presented on the display; and automatically delaying timing of the virtual shot, using the processor to automatically execute shot delay logic, by preventing release of the virtual shot until a center of the reticle is aligned to the visible marker.

4. The method of claim 3, wherein dynamically adjusting the target comprises:

determining a response representing a possible reaction by the target based on the impact location when the virtual shot misses the target; and adjusting the target according to the response based on the impact location.

5. The method of claim 1, wherein determining the impact location comprises:

producing one or more random variables corresponding to environmental parameters using the processor of the rifle scope to generate the environmental parameters;

determining ballistic data;

determining orientation information associated with the rifle scope relative to the target based on one or more signals from orientation sensors of the rifle scope at a time of the virtual shot; and calculating the impact location as a function of the one or more random variables, the ballistic data, and the orientation information.

6. The method of claim 1, wherein receiving the trigger pull signal comprises receiving an electrical signal from a trigger mechanism.

7. The method of claim 1, further comprising:

receiving instructions for generating the visual representation at an input interface of the rifle scope; and storing the instructions in a memory accessible to a processor of the rifle scope for providing the visual representation.

8. A rifle scope comprising:

a display;

optical sensors configured to capture optical data associated with a view area;

an input interface configured to receive a user input;

a processor coupled to the display, the optical sensors, and the input interface; and a memory coupled to the processor and configured to store instructions that, when executed by the processor, cause the processor to:

in a first mode:

receive optical data from the optical sensors of the rifle scope; and present the optical data to the display; and in a second mode:

provide a visual representation to the display, the visual representation generated to include a targeting environment including a target;

receive a trigger pull signal from the input interface;

determine an impact location of a virtual shot in response to receiving the trigger pull signal based on orientation data corresponding to an orientation of the rifle scope; and dynamically adjust the target within the visual representation based on determining the impact location.

9. The rifle scope of claim 8, wherein the instructions, when executed, cause the processor to adjust a position of the target based on the impact location.

10. The rifle scope of claim 8, further comprising:

at least one sensor configured to generate orientation information corresponding to an orientation of the rifle scope;

wherein the memory further comprises instructions that, when executed, cause the processor to:

insert a reticle within the visual representation corresponding to a center of the rifle scope; and adjust the virtual representation based on the orientation of the rifle scope.

11. The rifle scope of claim 10, wherein the memory further comprises instructions that, when executed, cause the processor to:

receive the user input to select the target; and apply a visual tag to the target within the visual representation in response to receiving the user input, the visual tag remaining on the target and visible within the visual representation after the target is selected.

12. The rifle scope of claim 11, further comprising instructions that, when executed, cause the processor to delay the virtual shot until the visual tag is aligned to the reticle.

13. The rifle scope of claim 8, wherein the instructions include further instructions that, when executed, cause the processor to:

determine a timing parameter corresponding to the trigger pull signal;

determine the orientation information from the at least one sensor corresponding to a timing parameter of the virtual shot; and calculate the impact location based on the timing parameter, the orientation information, ballistic data, and one or more randomly calculated environmental parameters corresponding to the visual representation.

14. The rifle scope of claim 8, wherein the instructions further include instructions that, when executed, cause the processor to:

determine a response based on the impact location, the response representing at least one possible reaction by the target in response to the impact location; and alter a position of the target based on determining the response.

15. The rifle scope of claim 8, wherein the memory is programmable via instructions received by the input interface.

16. A rifle scope including embedded training, the rifle scope comprising:

a display;

optical sensors configured to capture image data of a view area;

a controller coupled to the display and to the optical sensors and configured to:

in a first mode:

receive the image data associated with the view area from the optical sensors;

provide at least a portion of the image data to the display;

in a second mode:

provide a visual representation to the display, the visual representation generated to include a targeting environment including one or more targets;

determine a trigger pull;

determine an impact location for a shot taken in response to the trigger pull; and provide training results to the display by selectively adjusting at least one target within the visual representation in response to the trigger pull based on the determined impact location.

17. The rifle scope of claim 16, further comprising an input terminal coupled to the controller and configured to receive an electrical signal corresponding to the trigger pull.

18. The rifle scope of claim 16, further comprising a transceiver coupled to the controller and configured to communicate at least one of a visual representation timing indicator, the visual representation, and data associated with the trigger pull to another rifle scope through a wireless connection to provide a shared training environment.

19. The rifle scope of claim 16, further comprising:

at least one sensor coupled to the controller and configured to provide orientation information corresponding to an orientation of the rifle scope in response to determining the trigger pull; and wherein the controller is further configured to:

determine the orientation of the rifle scope relative to the at least one target at a time associated with the trigger pull;

determine an impact location within the visual representation relative to the at least one target; and selectively adjust the at least one target based on the impact location.

20. The rifle scope of claim 19, wherein the controller is configured to alter a visual appearance of the at least one target when the impact location corresponds to a location of the at least one target.

21. The rifle scope of claim 19, wherein the controller is configured to change a position of the at least one target within the visual representation when the impact location indicates that the at least one target is missed.

* * * * *